United States Patent [19]

Sung-shan

[11] 4,429,434

[45] Feb. 7, 1984

[54] TOOTHBRUSH

[76] Inventor: Peng Sung-shan, P.O. Box 19-252, Taipei, Taiwan

[21] Appl. No.: 343,096

[22] Filed: Jan. 27, 1982

[51] Int. Cl.[3] ..... A47L 5/02

[52] U.S. Cl. ..... 15/341; 15/167 R; 132/84 R

[58] Field of Search ..... 15/341, 167 R; 132/84 R

[56] References Cited

U.S. PATENT DOCUMENTS

| | | | |
|---|---|---|---|
| 1,757,650 | 5/1930 | Arico | 15/341 X |
| 1,924,152 | 8/1933 | Coney et al. | 15/167 R |
| 2,888,696 | 6/1959 | Longert | 15/167 R X |
| 4,288,883 | 9/1951 | Dolinsky | 15/167 R X |
| 4,292,705 | 10/1981 | Stouffer | 15/167 R X |

*Primary Examiner*—Chris K. Moore

*Attorney, Agent, or Firm*—Holman & Stern

[57] ABSTRACT

This invention offers a novel toothbrush capable of comfortably performing normal toothbrushing action, massaging the gums and teeth, and conveniently sucking and jetting out the food residues caught at the gaps between the teeth in general and between the molars in particular.

4 Claims, 10 Drawing Figures

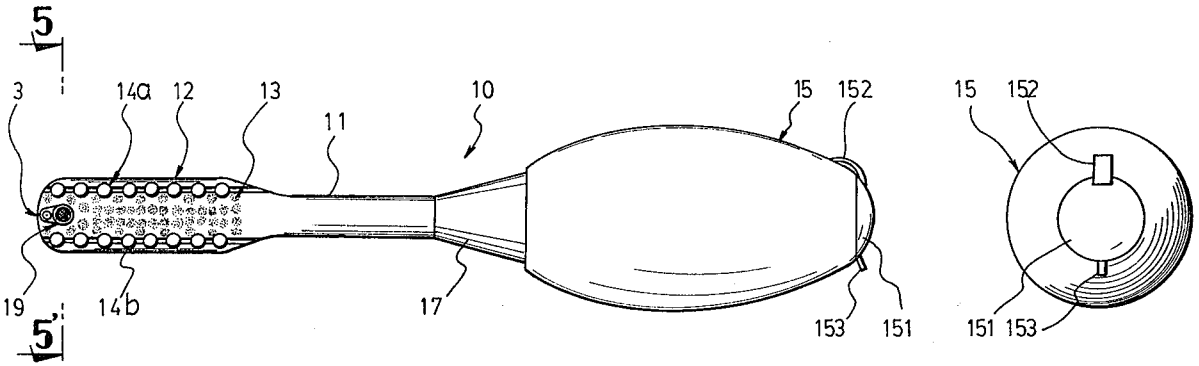
FIG 1
FIG 2
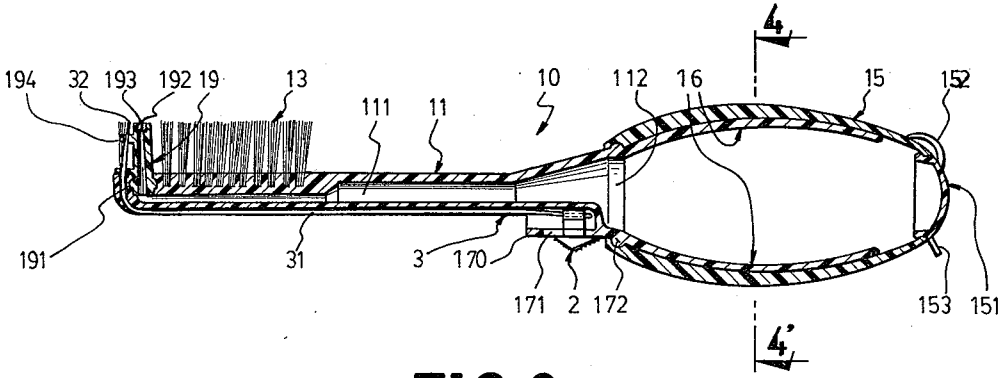
FIG 3
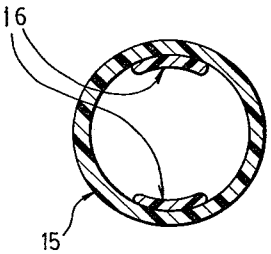
FIG 4
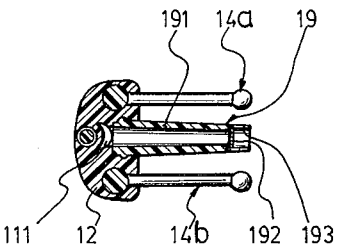
FIG 5

TOOTHBRUSH

BRIEF SUMMARY OF THE INVENTION

This invention is related to a novel toothbrush comprising a row of gum-massaging plastic bars on each one of two sides of a section of brush, a suction and fluid jet pipe at the front end of said brush section, an enclosed fluid channel at the center of the toothbrush handle body connecting the said suction and fluid jet pipe to the distal end of said toothbrush handle body, a squeeze bulb connected to the said distal end, and a partially closed channel on the back of said handle body for enclosing a tooth-picking flexible member actuated by a push button leading to an opening at one side of the said pipe. The operation thereof is characterized by massaging the gums with the two rows of plastic bars, by removing the food residues caught in the gaps between teeth with the suction and jet forces generated by pressing the squeeze bulb applied to the said gaps while the nozzle is contacting the said gaps, by making the toothbrush action more comfortable without hurting or bloodying gums with the said bars, and by picking out the food residues tightly caught in the gaps between teeth with the point of the tooth-picking member which is extended out by means of pressing the push button in case of emergency, in addition to achieving normal tooth-brushing purpose thru the toothbrush bristles. The toothbrush on sale or used by the people in general consists of a number of bristles which are planted on one end of a plastic bar. So during the tooth-brushing action, the two rows of bristles on the outer sides inevitably will contact the gums, making the user feel uncomfortable, and it is possible to make the gums shed blood, and what is more serious is to make the user feel gum pain. When people eat something, particularly meat, the food residues are often caught in the gaps between the teeth. If picking and removing them with the traditional toothpick is attempted, careless picking may hurt and bloody the gums. This inventor has read a report in the newspaper that someone suffers from tetanus because he picked the food residues caught at the gaps between his teeth with a toothpick. Therefore, using the toothpick should be avoided if possible. However, using this invention can minimize the chance of having to use the unsafe toothpick.

In view of the above, this inventor, thru research and development, has invented a novel toothbrush with the simplest structure based on the simplest principle which can offer more comfortable tooth-brushing action, massage the gums, conveniently suck and jet the food residues caught at the gaps between teeth, and in case of emergency, pick out the said food residues.

BRIEF DESCRIPTION OF THE SEVERAL VIEWS OF THE DRAWING

FIG. 1 is a plan view of this invention.

FIG. 2 is a right side view of this invention.

FIG. 3 is a longitudinal sectional view of this invention.

FIG. 4 is a cross-sectional view taken along the line 4—4' of FIG. 3.

FIG. 5 is a cross-sectional view taken along the line 5—5' of FIG. 1.

DETAILED DESCRIPTION

Figure 6:
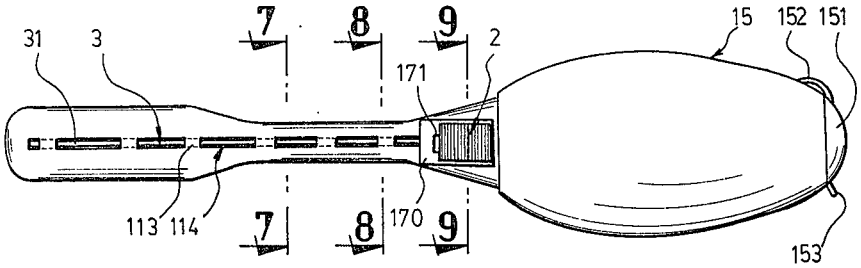
FIG. 6 is a bottom (back) view of this invention.
Figure 7:
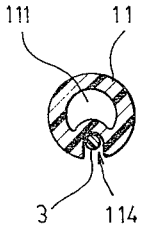
FIGS. 7 to 9 are cross-sectional views taken respectively along the lines 7—7', 8—8' and 9—9' of FIG. 6.
Figure 8:
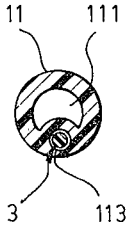
Figure 9:
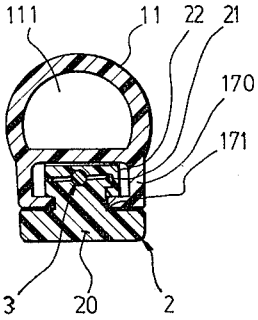

The invention can be best described hereinafter in reference to the drawing:

As shown in FIGS. 1 to 5, the novel toothbrush 10 of this invention consists of a row of gum-massaging plastic bars 14*a*, 14*b*, on each one of two sides of bristles 13 of brush section 12, a suction and fluid jet pipe 19 at the front end of bristle section 12, an enclosed fluid channel 111 at the center of toothbrush handle body 11, and said pipe 19 is joined to the handle body 112 at one end thereof, and at the other end is a funnel-shaped adapter 17, and a squeeze bulb 15 connected to said adapter 17.

Figure 10:
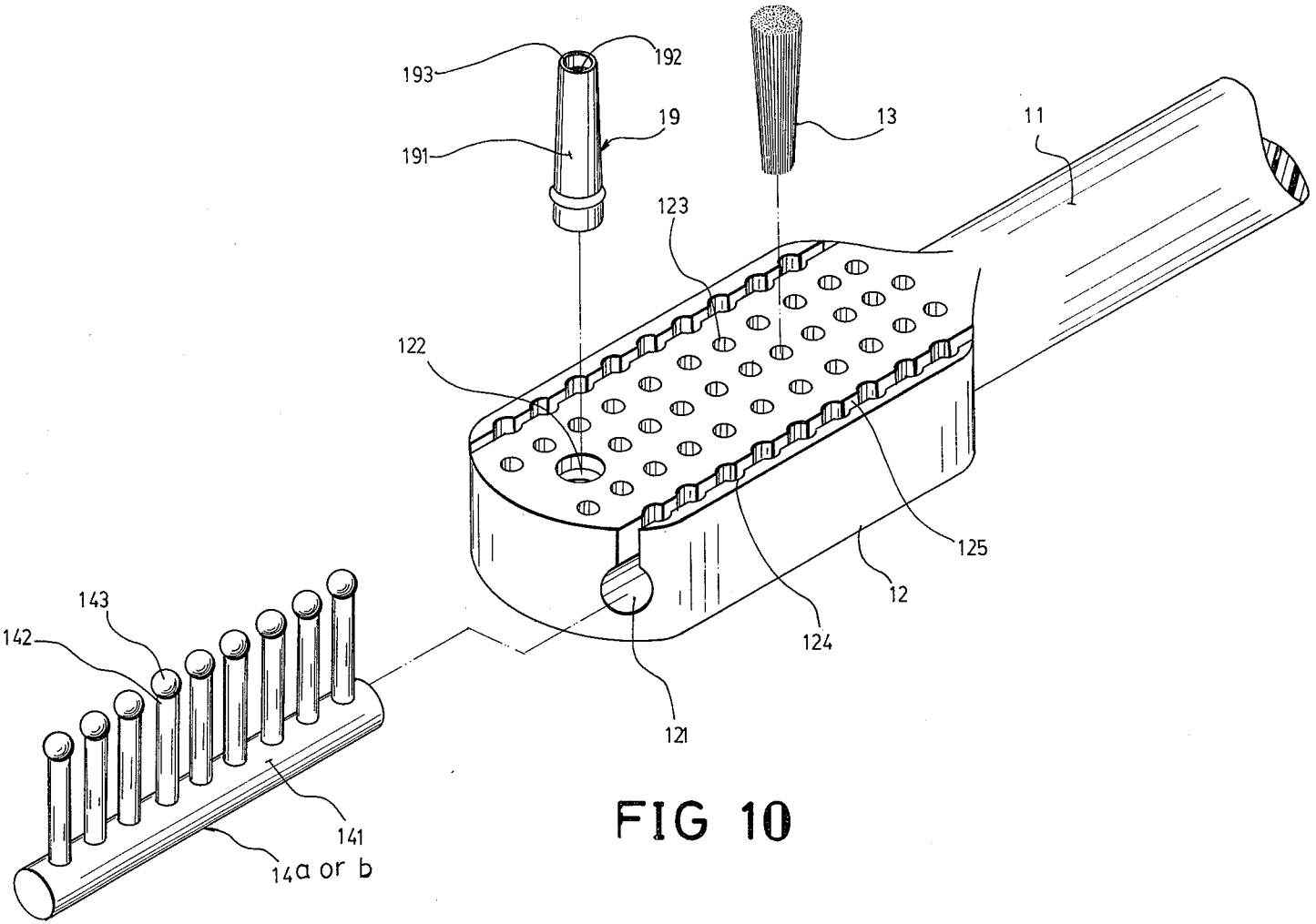
FIG. 10 is an exploded view of the bristle section.

As shown in FIG. 10, each of said two gum-massaging plastic bars 14*a*, 14*b* consists of a rod 141 whereon is mounted a plurality of brushing rods 142 each having a round bead 143 at the top. The said rod 141 is made of semi-soft rubber or similar material, and is inserted in the pre-set longitudinal holes 121*a*, 121*b*. The notched slot 125 is in the same surface where the bristles 13 are secured so as to hold the gum-massaging plastic bars 14*a*, 14*b*. Each brushing rod 142 is inserted in an enlarged notch 124 along the notched slot 125 and may be directly secured on both sides of bristle section seat 12, whereon several rows of bristle-securing holes 123 are placed at the center for securing the bristles 13. The said longitudinal holes 121 are set on the each side of body 12, and a hole 122 communicating with the toothbrush handle enclosed channel 111 is set at the front, side or at a suitable location with respect to section 12 for inserting the suction and airblast nozzle pipe 19.

When pressing and releasing the squeeze bulb 15 with the hand, the nozzle 192 of said pipe 19 will reach to the gap between the teeth to suck out food residues caught therebetween. Clean water can be sucked into the said pipe 19 by pressing and releasing the said squeeze bulb 15, and the clean water therein can be powerfully jetted out from the nozzle 192 for washing the teeth and gaps between the teeth by pressing and releasing the said squeeze bulb once again. The said suction and fluid jet pipe 19 is a semi-soft pipe body 191 made of rubber or synthetic resin of such hardness which should not hurt the gums in principle. The nozzle 192 with one or more orifices (or a net) inside is aimed at sucking out the food residues caught in the gaps between teeth. The said suction and jet pipe 19 should be designed to be optionally installed in the hole 122 on the bristles section 12 and removed therefrom in favor of the washing action. A convex seat 194 with an orifice at the side of pipe body 191 is designed to hold the tooth-picking flexible member 3 which will not move during toothbrushing. The squeeze bulb 15 is oval and can be easily held and pressed with a hand. From a hole at the rear end of said ball 15, a connecting piece 152 is extended to the movable lid 151 with a push-open handle 153 which is designed to push the said lid 15 open so as to pour water into the said ball 15 and enclosed fluid channel 111 at the center of toothbrush handle body 11 to make the water therein jet out from the suction and jet pipe 19 thru nozzle 192 to wash the said channel 111 and pipe 19. The front end of said squeeze bulb 15 is tightly installed on the funnel-shaped adapter 17 extending from the distal end 112 of toothbrush handle body 11 and be removed from said adapter 17 with some effort. Two or four elastic spring leaves 16 on the inner wall of squeeze bulb 15 are extended from the inner side of convex ring 172 holding the said bulb 15 so that after the said bulb 15 is pressed, these leaves 16 can help the said bulb 15 restore its original shape.

As shown in FIG. 3, and 6 thru 9, a holding edge 170 with a long hole 171 on one side of said adapter 17 at the distal end 112 of said handle body 11 is designed to hold a push button (or switch) 2 so as to install a tooth-picking flexible member 3 in the partially enclosed channel 113 on the back side of said handle body 11 and make the tooth-picking member 31 penetrate the front end of bristle section body 12 so that the tooth-picking member point 32 can penetrate the convex seat 194 on one side of the suction and jet pipe body 191. A slot 21 with a movable fastener 22 is located on the upper side of seat body 20 of push button (or switch) so that the tooth-picking member 3 can be fastened on and removed from the push button 2 thru the said movable fastener 22. Meantime, pushing the said push button 2 to and fro with the hand can actuate the tooth-picking member 31 for reciprocation so as to control the movement of said point 32 for extending out from or retracting away from the plane of bristles 13.

In view of the above, using the novel toothbrush of this invention can normally brush the user's teeth and suction and jet out the food residues caught in the gaps between teeth, and in case of emergency, the said food residues can be picked out with the toothpicking member 3. In addition, this novel toothbrush is obviously characterized by directly contacting and rubbing the gums or teeth and teethridge thru the brushing rods 142 of gums-massaging plastic bars 14 while brushing teeth optionally without possibility of hurting the gums or making same shed blood so as to achieve the purpose of perfectly and strictly brushing teeth.

I claim:

1. A novel toothbrush comprising: a row of gum-massaging plastic bars on each one of two sides of a brush bristle section seat; a suction and fluid jet pipe at the front end of said bristle section seat, an enclosed fluid channel at the center of said toothbrush handle body, the said suction and jet pipe being connected to said fluid channel, said channel leading to the distal end of said toothbrush handle body; a squeeze bulb connected to the said distal end, and a partially closed channel on the back of said handle body for enclosing a tooth-picking flexible member controlled by a slidable push button; said partially closed channel leading to an aperture at one side of the said suction and jet pipe; the operation of said toothbrush being characterized by massaging the gums with the two rows of plastic bars, by removing the food residues caught in the gaps between teeth with the suction fluid and jet forces generated by pressing the squeeze bulb applied to the said gaps while the nozzle of said suction and fluid jet pipe is contacting the said gaps, by making the tooth-brushing action more comfortable without hurting or bloodying the gums with the said bars, and by picking out the food residues tightly caught at the gaps between teeth with a pointed end of said tooth-picking member which is extended out by means of sliding the push button, in addition to achieving normal tooth-brushing purposes with the toothbrush bristles.

2. A novel toothbrush as claimed in claim 1 wherein each gum-massaging plastic bar consists of a rod whereon is mounted a plurality of brushing rods each having a round bead at the top and is inserted in the preset longitudinal hole.

3. A novel toothbrush as claimed in claim 1 or 2 wherein several rows of bristle-securing holes are placed at the center of bristle section seat for securing the bristles, and said gum-massaging plastic bars are set on the two sides thereof, and a hole communicating with the toothbrush handle enclosed fluid channel is set at the front side thereof for inserting the suction and jet pipe which can be optionally removed or installed.

4. A novel toothbrush as claimed in claim 1 wherein the suction and fluid jet pipe is a semi-soft pipe of which the nozzle has one or more orifices.

* * * * *